United States Patent [19]

Shannon

[11] Patent Number: 4,565,591

[45] Date of Patent: Jan. 21, 1986

[54] METHOD AND APPARATUS FOR MAKING A MAGNETICALLY LOADED INSULATED ELECTRICAL CONDUCTOR

[75] Inventor: Michael A. Shannon, Glenburnie, Canada

[73] Assignee: Northern Telecom Limited, Montreal, Canada

[21] Appl. No.: 597,647

[22] Filed: Apr. 6, 1984

[51] Int. Cl.[4] ..... H01B 13/06

[52] U.S. Cl. ..... 156/51; 118/640; 118/DIG. 18; 156/272.4; 156/379.6; 174/36; 178/45; 427/47; 427/117; 427/120; 427/130

[58] Field of Search ..... 156/272.4, 47, 51, 244.12, 156/379.6; 427/47, 117, 120, 128, 130; 174/36, 113 R; 178/45; 118/640, DIG. 18, DIG. 19; 264/104, 105

[56] References Cited

U.S. PATENT DOCUMENTS

| | | | |
|---|---|---|---|
| 4,079,192 | 3/1978 | Josse | 174/36 X |
| 4,369,204 | 1/1983 | Wolf et al. | 427/47 X |
| 4,440,974 | 4/1984 | Naudet | 174/36 X |
| 4,514,435 | 4/1985 | Shannon et al. | 427/47 X |
| 4,515,826 | 5/1985 | Garner et al. | 427/47 X |
| 4,518,633 | 5/1985 | Walling et al. | 427/120 |

*Primary Examiner*—Robert A. Dawson
*Attorney, Agent, or Firm*—R. J. Austin

[57] ABSTRACT

Making an insulated electrical conductor having an insulation layer formed from dielectric carrier with magnetically permeable particles dispersed therein in which the conductor bearing the layer is passed through a magnetic field to cause an increase in magnetization of magnetic domains of the particles towards a single direction.

15 Claims, 8 Drawing Figures

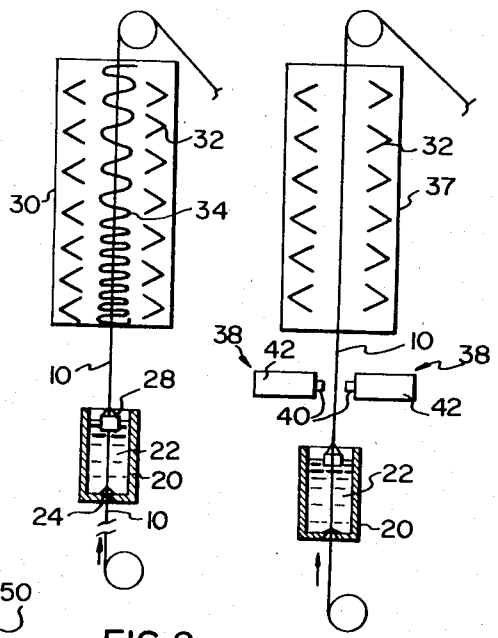
FIG. 4
FIG. 2
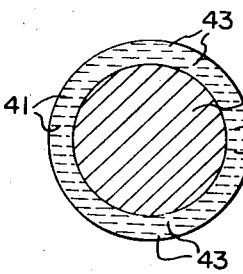
FIG. 5
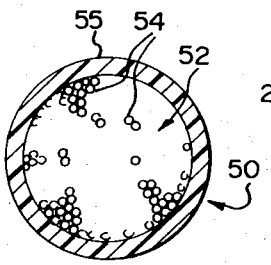
FIG. 6
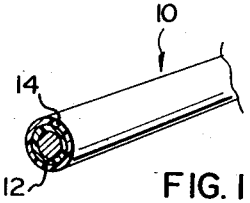
FIG. 1
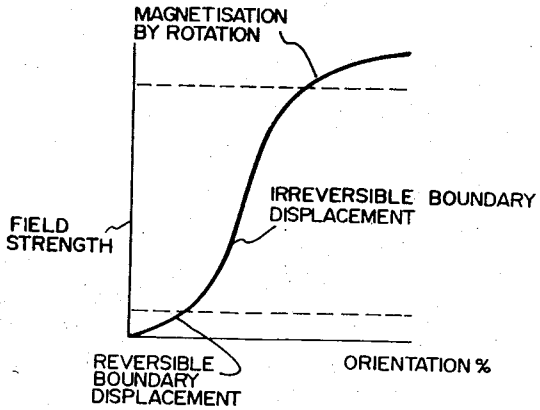
FIG. 3

METHOD AND APPARATUS FOR MAKING A MAGNETICALLY LOADED INSULATED ELECTRICAL CONDUCTOR

This invention relates to methods and apparatus for making insulated electrical conductors.

In the telecommunications cable and power cable industries, it is common practice to surround electrical conductors with at least one layer of insulation which affects the electrical performance of the conductor, e.g. by producing a desired dielectric effect and helping to provide other design characteristics such as mutual capacitance. For various reasons, continuous inductive loadings have been proposed and used in dielectric layers of electrical conductors. These continuous inductive loadings have comprised discrete particles of a magnetic material such as ferrite, which are dispersed throughout a continuous dielectric carrier layer of polymeric substance such as rubber or other plastic. Such a layer will be referred to in this specification as "continuous loaded layer".

In order to provide the desired inductive characteristics continuously along a conductor, it is necessary to have substantially even dispersion of the particles throughout the layer. It is also necessary that other parameters such as electrical and magnetic influences of the particles should be controlled.

The present invention provides a method and apparatus for making insulated conductor in which constancy in the magnetic properties of magnetically permeable particles in a continuous loaded layer are improved.

According to one aspect of the invention, there is provided a method of making an insulated electrical conductor comprising a conductor having an insulation layer formed from a dielectric carrier provided with a plurality of magnetically permeable particles dispersed therein; wherein after the addition of the layer to the conductor, said method comprises passing the conductor through a magnetic field to cause an increase in magnetization of the magnetic domains of the particles towards a single direction.

The term "magnetic domains" is used in the sense of the use of the term in magnetic domain theory as discussed in "College Physics", 3rd edition, chapter 35, by Sears and Zemansky, 1961. As explained therein during action of an applied field to a ferromagnetic substance, some aligning influence other than the applied field must act upon molecular magnets forming the substance. This aligning influence is now understood to be small regions called "domains" which exist in ferromagnetic materials. Domain size is typically between $10^{-6}$ and $10^{-2}$ $cm^3$ of these domains the molecular magnetic moments are all aligned parallel to one another as a result of molecular interactions. While directions of magnetization in different domains are not necessarily parallel to one another in an unmagnetized specimen, when the specimen is subjected to a magnetic field, the resultant magnetization may increase either by growth of favourably oriented domains or by domain rotation towards the direction of the field.

Each magnetically permeable particle referred to in the method of the invention is composed of such domains and in the method, the increase in magnetization towards a single direction depends upon the strength of the field and is preferably by domain rotation although some growth of favourably oriented domains may take place.

The inventive method is applicable both to increase magnetization towards a single direction in an insulation layer upon a single conductor and upon a plurality of conductors forming the core for a cable. In the case of the single conductor, it may be passed through the magnetic field either before or after the dielectric carrier is dried. In the event that the dielectric carrier is in a liquid state, then the conductor is coated with a mixture of fluid carrier and magnetically permeable particles and is passed directly through the field before entering or whilst inside a drying oven. In this particular method, increase in magnetization is also assisted by a change in orientation of some at least of the particles to assist in aligning the directions of magnetization of the domains of each of these particles towards the single direction. Drying of the carrier then holds the particles in their oriented positions.

According to another aspect of the invention, there is provided an apparatus for making an insulated electrical conductor comprising means for moving the conductor along a feedpath and through a particular special region after providing it with an insulation layer formed from a dielectric carrier provided with a plurality of magnetically permeable particles dispersed therein, and means to produce a magnetic field extending through said spacial region and of sufficient strength to cause an increase in magnetization of the magnetic domains of the particles towards a single direction.

In one preferred apparatus to enable the magnetization in the domains to be increased towards a single direction with the dielectric carrier in a fluid state, the magnetic field producing means is disposed downstream along the feedpath from a means for coating the conductor with a mixture of the fluid carrier and the particles. In a practical arrangement, the feedpath extends vertically from the coating means with the coating and magnetic field producing means disposed vertically one above the other. A drying oven may be disposed downstream of the magnetic field producing means or may be positioned to surround such means.

The magnetic field producing means may be operable to produce flux lines either across or along the feedpath.

The invention also includes apparatus for making an electrical cable having a core comprising a plurality of conductors each individually insulated with an insulation layer formed from a dielectric carrier provided with a plurality of magnetically permeable particles dispersed therein, the apparatus comprising means to move the cable along a feedpath and through a particular spacial region, and means to provide a magnetic field with flux lines extending through said spacial region and of sufficient strength to cause an increase in magnetization of the magnetic domains of the particles towards a single direction.

Embodiments of the invention will now be described, by way of example, with references to the accompanying drawings, in which:

FIG. 1 is an isometric view of a conductor having a continuous loaded layer;

FIG. 2 is a diagrammatic side elevational view, partly in section of apparatus according to a first embodiment for applying the loaded layer to conductor of FIG. 1;

FIG. 3 is a graph illustrating the magnetic flux strengths required to produce desired forms of alignment of magnetization of ferrite particles towards a desired direction;

FIG. 4 is a side elevational view of apparatus according to a second embodiment;

FIG. 5 is a greatly enlarged cross-sectional view through a conductor after it has passed through the apparatus of the second embodiment;

FIG. 6 is a cross-sectional view through a cable comprising a core formed from twisted pairs of conductors.

Figure 8:
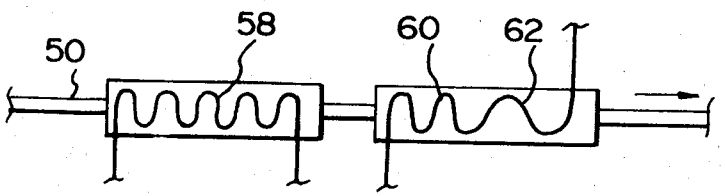
FIGS. 7 and 8 are side-elevational views of apparatus according to third and fourth embodiments for increasing magnetization of ferrite particles in loaded layers of the cable of FIG. 6 towards a single direction.

FIG. 1 shows an insulated conductor comprising a conductor 10 having two layers of insulation provided upon it, an inner layer 12 in the form of a continuous loaded layer and an outer layer 14 of other insulating material. The continuous loaded layer is in the form of a latex coating which forms a dielectric carrier for a plurality of ferrite particles. These particles are of a size such that around 99.5% of them will pass through a 325 mesh screen. The particles have their magnetic domains oriented towards a single direction. This direction is either axially of the conductor as provided by one of the methods according to the invention or across the conductor at angles substantially normal to its axis as provided by an alternative method.

To provide the ferrite particles with their general orientation towards the axial direction, apparatus according to a first embodiment and as shown in FIG. 2 comprises a container 20 holding a mixture of a fluid dielectric carrier which is any carrier suitable for the purpose, e.g. a polymer or a latex material. It homogeneously incorporates a plurality of magnetically permeable particles, which are ferrite particles as discussed with regard to FIG. 1. In this embodiment, the carrier is a latex emulsion with a 45% solids content by weight of the total emulsion and which is crosslinkable to enable the finished coat to be made by curing. A suitable emulsion is an acrylic emulsion sold by Rhoplex under their trade number NE 1612. The base of the container is formed with an orifice 24 having a seal for sealing engagement with conductor 10 as it is fed upwardly through the bath to become coated with the mixture 22 and through a die means 28, which is carried upon the surface of the mixture. The conductor then proceeds upwardly away from the bath and through a vertical drying oven 30. The die means 28 is of any suitable construction and may be of the construction described in U.S. Pat. No. 4,518,633, granted May 21, 1985 for "Production of Insulated Electrical Conductors" in the names of J. H. Walling, M. A. Shannon and G. Arbuthnot. The particular die means described in that application is one which is free to float across the mixture to assist in the forming of a concentric layer of the mixture 22 upon the conductor, the free floating of the die means accompanying any lateral movement of the conductor after it emerges from the bath to ensure this concentricity.

The drying oven 30 is of upwardly cylindrical construction and is provided around its inside surface with a plurality of circumferentially and axially extending infra-red heaters 32 of known construction. Disposed within the oven is a means to produce a magnetic field with flux lines extending through a central spacial region of the oven, this region including the line of the feedpath through the oven. The magnetic field producing means comprises a magnetic coil 34 which is concentrically disposed along the feedpath and extends upwardly through the oven. The coil 34 is connected at its ends to a source of electric power not shown. The coil is designed to reduce the strength of the magnetic field towards the downstream end of the feedpath, i.e. towards the top of the coil, and for this purpose the windings of the coil as they extend towards the top end, become further spaced apart axially of the coil so that the winding intensity is reduced.

In use of the apparatus shown by FIG. 2, the conductor is passed upwardly through the container 20 and is provided with the coating formed from the mixture 22.

After the conductor is coated with the particles by the apparatus and method described in the aforementioned patent entitled "Production of Insulated Electrical Conductors", then the conductor 10 is fed upwardly through the coil 34 and through the drying oven. As the conductor passes through the coil, it is subjected to the strength of the magnetic field, the flux lines of which extend generally in the direction of the feedpath. Before entering the coil, it is possible that the ferrite particles will extend randomly in all directions within the coating on the conductor. More exactly, the magnetization of the magnetic domains of the particles extend randomly and haphazardly in various directions. During passage of the conductor along the coil, the magnetic field influences the magnetic domains so that the field increases the magnetization of the domains of the particles towards the axial direction of the conductor. The manner in which the domains are orientated is dependent amongst other things upon the strength of the field, the type of ferrite used and its geometry. For instance, for a relatively weak field, the increase in magnetism will be changed by means of domain boundary displacement so that favourably oriented domains, i.e. those extending generally in the axial direction, increase in size at the expense of other domains extending in other directions. However, with this type of change in magnetization, there is a possibility that a reversal in orientation will take place upon the magnetic field being removed. Hence a relatively weak field is deemed to be undesirable if the object of this invention is to be obtained. In stronger fields, the changes in magnetization are less reversible and become irreversible as the field increases in strength. For the stronger fields change in orientation will take place, not only by domain growth, but also by orientation caused by rotation of the domains themselves towards alignment with the single direction, i.e. the axis of the conductor. Should the magnetic field be of sufficient strength, then the increase in magnetization may also be caused at least partly by orientation of the particles themselves for the purpose of giving a general domain orientation which most favourably lies towards the axial direction. This effect upon the increase in magnetization being dependent upon the strength of the field is illustrated by FIG. 3, which shows a typical curve for magnetization effect upon domains for different field strengths. The two axes of the graph are the field strength and the percentage domains which are oriented to the desired direction. As can be seen for weak field strengths, there are small changes in the direction of magnetization of the domains and these changes are by way of domain growth which is reversible as just been stated. At relatively stronger field strengths, there is an irreversibility in the change in direction of magnetization, and this change in magnetization takes place also because of rotation of the domains themselves.

Hence with the use of the apparatus described with reference to FIG. 2, the degree of change in orientation to achieve the desired effect and its degree of permanence is dependent upon the strength of the field.

The use of a coil having its convolutions more widely spaced apart towards the downstream end of the feedpath ensures that the strength of the magnetic field decreases towards the end of the coil. This decrease may be substantial and ensures that as the conductor moves out of the coil, the influence of the magnetic field is substantially negligible and will only have a negligible effect on the direction of the magnetization of the domains. In contrast to this, if the strength of the field at the end of the coil were substantial, than any orientation into the desired axial direction of the domains would be partly nullified by the sudden change in the direction of the field existing at the end of the coil.

In a second embodiment as shown in FIG. 4, an application container 20 and associated equipment for the mixture 22 is of the same construction as described in the first embodiment. The second embodiment has means for creating a magnetic field which is different from that described in the first embodiment. As shown by FIG. 4, this means 36 is disposed along the feedpath between the applicator bath and a drying oven 37. Thus the insulation is acted on by the magnetic means only with the layer in a fluid state. In this particular embodiment, the means 36 comprises two solenoids 38 each having a soft iron core 40 disposed within a coil 42 of the solenoid. Solenoids are disposed with north and south poles facing each other across the feedpath whereby the solenoids operate to create intensity in the magnetic field across the feedpath. In use of the apparatus of FIG. 4, after the conductor 10 has passed through the applicator bath, it moves through the magnetic field and the field strength increases the magnetization of the domains transversely of the length of the conductor with the domains tending to be orientated towards a single line of direction passing through the conductor. This direction which follows the flux lines of the field is shown by FIG. 5 which represents the domains diagrammatically and substantially enlarged. As can be seen in this particular structure through the conductor, the domains 41 lying to the sides of the conductor in the figure lie in a radial direction, whereas those lying towards the top and bottom of the conductor at 43 extend tangentially of the conductor. After domain orientation, the conductor is then fed through the oven to dry the coating and help to stabilize the magnetization direction.

Change in direction of magnetization may also be effected for conductors in a finished cable. For instance, the telecommunications cable 50 of FIG. 6 comprises a core 52 formed from a plurality of twisted conductor pairs 54 and having a polymer jacket 55. Each conductor has a continuous loaded layer including ferrite particles. This is a typical structure for a telecommunications cable. This cable, however, should not be provided with a metallic sheath as this will detract from any influence that the magnetizing effect will have upon the domains of the conductors.

Figure 7:
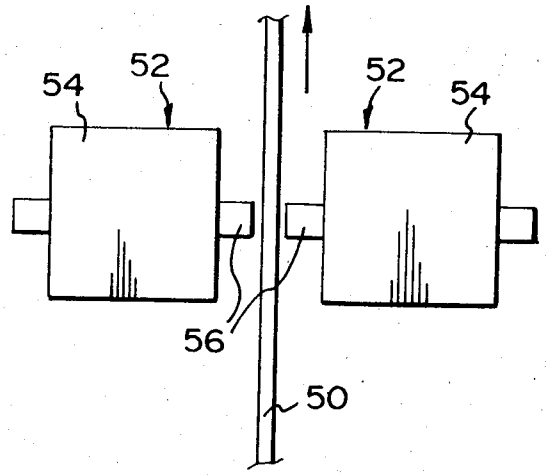

The cable 50 is fed along a feedpath (FIG. 7) to a take-up reel (not shown) during which time it passes through a magnetic field produced by a means 52 which, in a similar manner to the second embodiment, is provided by two solenoids 54. The soft iron cores 56 of the solenoids cause an intensity in the magnetic field across the feedpath, and this intensity in the strength of the field increases the magnetization of the domains of the ferrite particles in the conductors towards a direction which lies normal to the axial length of the cable. As will be appreciated, this direction is not with regard to the axis of each of the conductors, because the conductors follow tortuous paths along the cable. Thus the direction of the general magnetization of the domains of each conductor changes along the conductor length in a continuous fashion and this change is dependent upon the angular positional change of the conductor in the cable axis. Hence, each conductor has its domains oriented at a specific angle relative to the cable axis and the general direction of orientation is substantially the same throughout the length of the cable for all conductors. As a result of this, the loaded layers upon the conductors average out the inductive effect from one conductor to another.

In a fourth embodiment as shown by FIG. 8, the cable 50 is fed through a means for creating a magnetic field provided by two solenoid coils 58 and 60 disposed along the length of the cable. Downstream end of the solenoid coil 60 has its windings 62 increasing in axial length, whereby there are fewer windings per unit length of the coil. The reason for this is to reduce the strength of the magnetic field at the downstream end so as to not suddenly effect undesirable directional change upon the magnetization of the domains as the cable emerges from the magnetic field. The magnetic field created by the two coils increases the magnetization of the domains of the ferrite particles on the conductors towards the axial direction of the cable. As in the third embodiment, this direction is not consistent along each conductor because of the angular change in position of each conductor along the cable. However, the effect of this directional change is substantially the same in all conductors, whereby there is an averaging effect in inductance of all of the conductors along the cable.

As may be seen from the third and fourth embodiment, the change in direction of magnetization of the domains may be affected after manufacture of the cable even though the orientation of the particles themselves cannot be effected because of the solidified nature of the insulation upon the conductors.

What is claimed is:

1. A method of making an insulated electrical conductor comprising a solid conductor having an insulation layer formed from a dielectric carrier provided with a plurality of magnetically permeable particles homogeneously dispersed therein, wherein said method comprises applying the layer to the solid conductor with the dielectric carrier in fluid form and passing the solid conductor along a feedpath and axially through the windings of a coil which is energized to create a magnetic field and the field causes an increase in magnetization of magnetic domains of the particles towards the axial direction of the conductor while maintaining the particles homogeneously dispersed.

2. A method according to claim 1, comprising decreasing the strength of the field towards the downstream end of the coil to reduce any adverse effect upon the direction of magnetization of the domains as they move out of the field.

3. A method according to claim 1, comprising passing the conductor through the magnetic field to cause said increase in magnetization towards the single direction with the carrier in its fluid form, and then drying the carrier.

4. A method according to claim 1, comprising passing the conductor through the magnetic field to cause said increase in magnetization towards the single direction, and drying the carrier progressively as it passes through the field.

5. A method of making a core for an electric cable, said core comprising a plurality of conductors each having a dry insulation layer formed from a dielectric carrier provided with a plurality of magnetically permeable particles homogeneously dispersed therein, wherein said method comprises taking the core with each conductor in solid condition and surrounded with its dry insulation layer and passing the core along a feedpath and axially through the turns of a coil which is energized to create a magnetic field and the field causes an increase in magnetization of magnetic domains of the particles towards the axial direction of the core while maintaining the particles homogeneously dispersed.

6. A method according to claim 5, comprising decreasing the strength of the field towards the downstream end of the coil to reduce any adverse effect upon the direction of magnetization of the domains as they move out of the field.

7. Apparatus for making an electrical conductor insulated with an insulation layer formed from a dielectric carrier provided with a plurality of magnetically permeable particles homogeneously dispersed therein comprising means for moving the conductor in solid condition along a feedpath and through a particular spacial region means upstream along the feedpath from the spacial region for providing the solid conductor with the insulation layer while the dielectric carrier is in a fluid condition, and means to produce a magnetic field extending through said spacial region and only of sufficient strength to cause an increase in magnetization of the magnetic domains of the particles towards a single direction.

8. Apparatus according to claim 7, wherein the magnetic field producing means comprises windings of a coil which extends along the feedpath with the windings surrounding the feedpath.

9. Apparatus according to claim 8, wherein the number of windings per unit length of the coil decrease towards the downstream end of the feedpath.

10. Apparatus according to claim 7, wherein the magnetic field producing means comprises two magnets disposed at sides of the field path.

11. Apparatus according to claim 7, wherein the magnets are formed by cores of two solenoids disposed at the sides of the feedpath.

12. Apparatus according to claim 7, wherein the feedpath extends vertically from the means for providing the insulation layer to the magnetic field producing means.

13. Apparatus according to claim 12, further comprising a drying oven for the fluid dielectric carrier, the magnetic field producing means disposed along the feedpath and within the oven.

14. Apparatus according to claim 12, further comprising a drying oven for the fluid dielectric carrier, the magnetic field producing means disposed between the coating means and the oven.

15. Apparatus for making an electrical cable having a core comprising a plurality of conductors each individually insulated with an insulation layer formed from a dielectric carrier provided with a plurality of magnetically permeable particles dispersed therein, the apparatus comprising means to move the cable along a feedpath and through a particular spacial region, with the conductors in solid condition and carrying the insulation layers, and means to produce a magnet field with flux lines extending through said spacial region and of sufficient strength to cause an increase in magnetization of the magnetic domains of the particles towards a single direction while maintaining the particles homogeneously dispersed.

* * * * *